United States Patent [19]

Shafer et al.

[11] Patent Number: 4,624,367

[45] Date of Patent: Nov. 25, 1986

[54] METHOD AND APPARATUS FOR DETERMINING CONFORMITY OF A PREDETERMINED SHAPE RELATED CHARACTERISTICS OF AN OBJECT OR STREAM OF OBJECTS BY SHAPE ANALYSIS

[76] Inventors: John L. Shafer, 15602 Winmoss Ct., Houston, Tex. 77210; Robert Ehrlich, 2510 Stratford Rd., Columbia, S.C. 29204

[21] Appl. No.: 602,533

[22] Filed: Apr. 20, 1984

[51] Int. Cl.[4] ..... B07C 5/00

[52] U.S. Cl. ..... 209/577; 209/586; 209/587; 356/394; 364/498; 364/576; 382/25; 382/43

[58] Field of Search ..... 209/576–579, 209/586, 587, 589, 639, 939; 358/96, 107; 382/25, 43, 1, 23; 356/376, 394; 364/497–499, 560, 576

[56] References Cited

U.S. PATENT DOCUMENTS

| | | | |
|---|---|---|---|
| 3,097,744 | 7/1963 | Hutter et al. | 209/578 X |
| 3,142,383 | 7/1964 | Boyer | 209/586 X |
| 3,357,557 | 12/1965 | Austin | 209/587 |
| 3,545,610 | 12/1970 | Kelly et al. | 209/579 |
| 3,901,388 | 8/1975 | Kelly | 209/587 |
| 3,901,793 | 8/1975 | Buchot et al. | 209/578 X |
| 3,977,526 | 8/1976 | Gordon et al. | 209/564 |
| 4,057,146 | 11/1977 | Castaneda et al. | 209/586 X |
| 4,084,255 | 4/1978 | Casasent et al. | 382/43 X |
| 4,122,952 | 10/1978 | Richards | 209/579 |
| 4,139,303 | 2/1979 | Carlson et al. | 382/43 X |
| 4,164,788 | 8/1979 | Jain | 382/43 |
| 4,183,013 | 1/1980 | Agrawala et al. | 382/25 X |
| 4,236,640 | 12/1980 | Knight | 209/587 |
| 4,321,680 | 3/1982 | Bertrand et al. | 364/576 X |
| 4,360,274 | 11/1982 | Norton-Wayne | 356/376 X |
| 4,361,830 | 11/1982 | Honma et al. | 382/25 X |
| 4,365,303 | 12/1982 | Hannah et al. | 364/498 |
| 4,407,415 | 10/1983 | Bohme et al. | 209/556 |
| 4,459,027 | 7/1984 | Kafri et al. | 356/376 |

FOREIGN PATENT DOCUMENTS

| | | | |
|---|---|---|---|
| 0439323 | 11/1974 | U.S.S.R. | 209/587 |
| 0939138 | 7/1982 | U.S.S.R. | 209/577 |
| 0994061 | 2/1983 | U.S.S.R. | 209/589 |

OTHER PUBLICATIONS

William E. Full et al, "Some Approaches for Location of Centroides of Quartz Grain Outlines to Increase Homology Between Fourier Amplitude Spectra", 1982, Mathematical Geology, vol. 14, No. 1, pp. 43–55.

R. Ehrlich et al, "An Exact Method for Characterization of Grain Shape", Mar. 1970, pp. 205–212, Journal of Sedimentary Petrology, vol. 40, No. 1.

J. E. Klovan et al, "Extended CABFAC and QModel Computer Programs for Q-Mode Factor Analysis of Compositional Data", 1976, Computers & Geosciences, vol. 1, pp. 161–178.

W. E. Full et al, "Extended QModel—Objective Definition of External End Members in the Analysis of Mixtures", Mathematical Geology, vol. 13, No. 4, 1981.

*Primary Examiner*—Robert B. Reeves
*Assistant Examiner*—Edward M. Wacyra
*Attorney, Agent, or Firm*—Joseph J. Dvorak

[57] ABSTRACT

In its simplest sense, the present invnetion contemplates a method and apparatus for determining a characteristic or property of randomly oriented, irregularly shaped objects by obtaining an image profile of the object, selecting a plurality of edge points from the image profile and obtaining therefrom a parameter related to the characteristic or property of the object. Having determined the characteristic or property of the objects analyzed, they can be treated appropriately, for example, sorted and the like.

8 Claims, 4 Drawing Figures

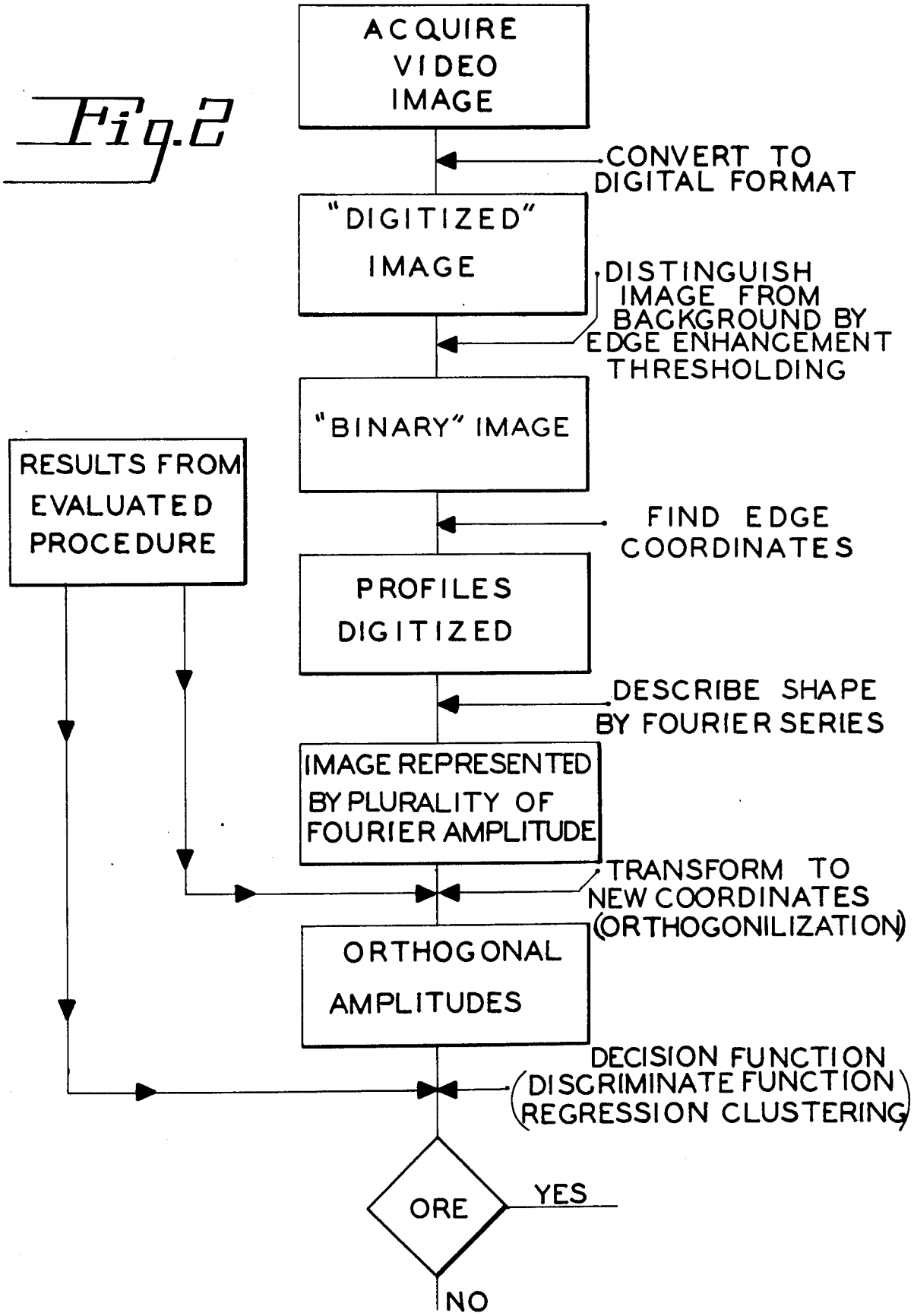
Fig.2
ACQUIRE VIDEO IMAGE
CONVERT TO DIGITAL FORMAT
"DIGITIZED" IMAGE
DISTINGUISH IMAGE FROM BACKGROUND BY EDGE ENHANCEMENT THRESHOLDING
"BINARY" IMAGE
RESULTS FROM EVALUATED PROCEDURE
FIND EDGE COORDINATES
PROFILES DIGITIZED
DESCRIBE SHAPE BY FOURIER SERIES
IMAGE REPRESENTED BY PLURALITY OF FOURIER AMPLITUDE
TRANSFORM TO NEW COORDINATES (ORTHOGONILIZATION)
ORTHOGONAL AMPLITUDES
DECISION FUNCTION (DISCRIMINATE FUNCTION REGRESSION CLUSTERING)
ORE
YES
NO Fig. 3
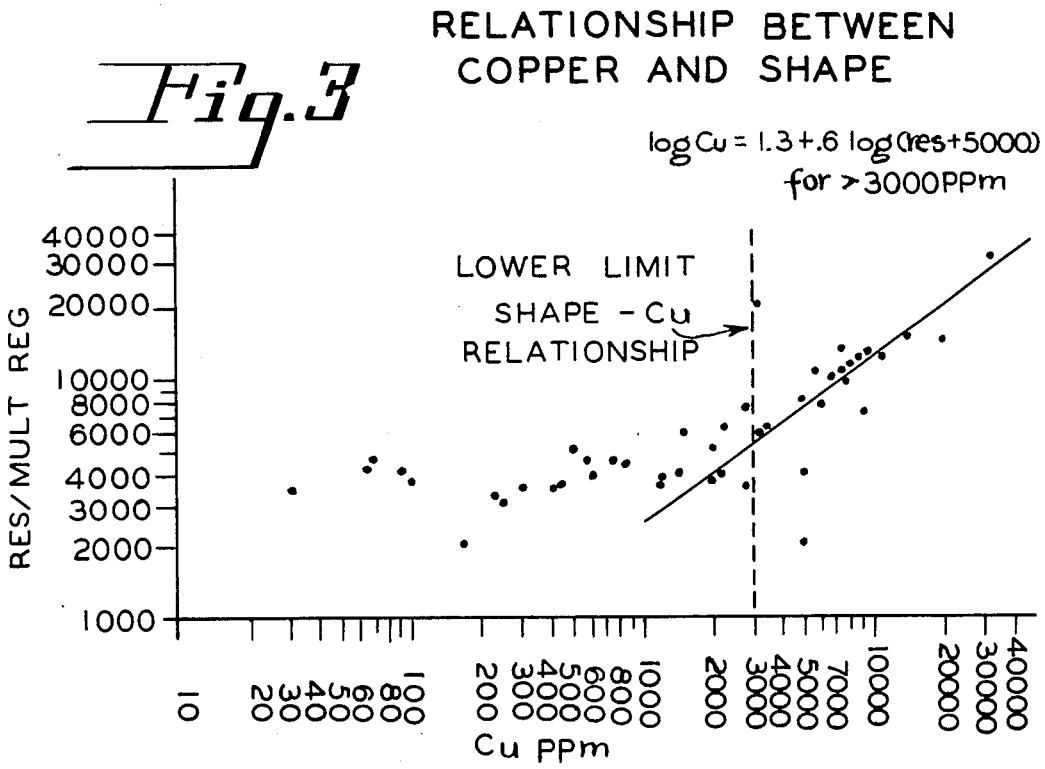
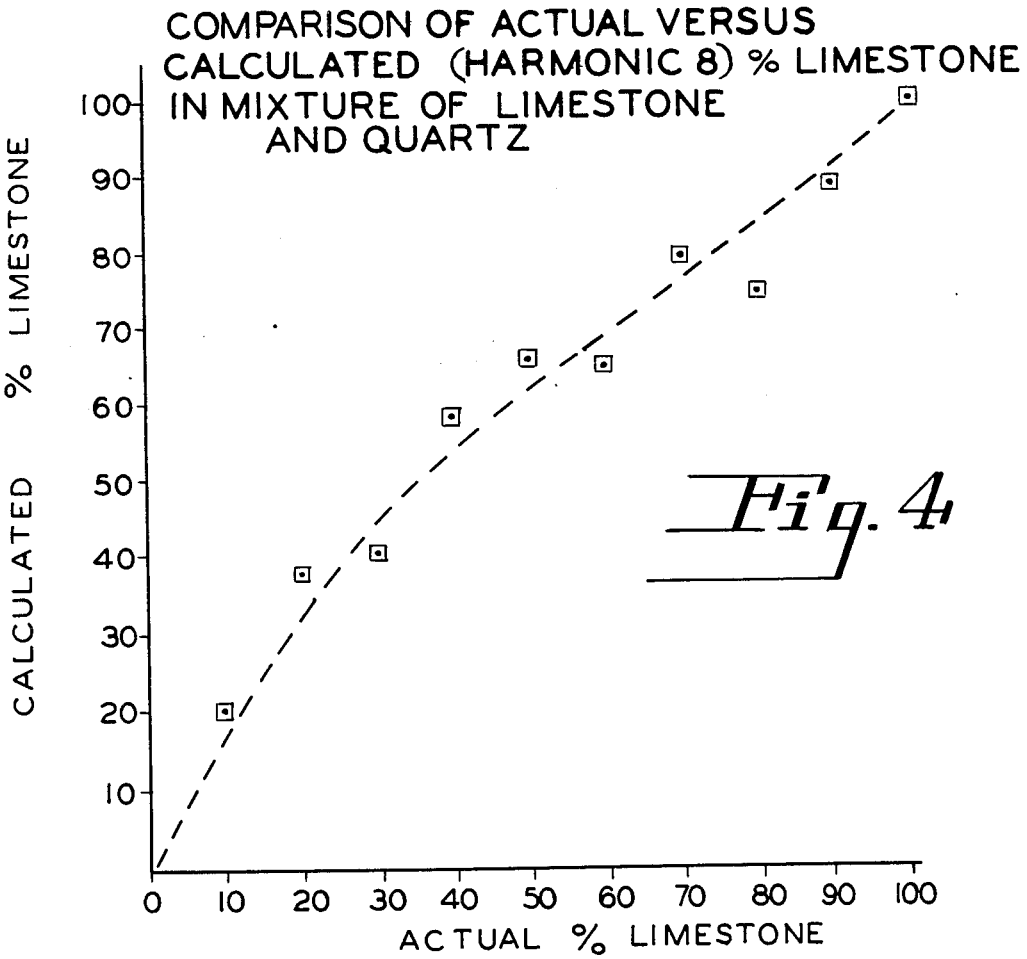
Fig. 4

METHOD AND APPARATUS FOR DETERMINING CONFORMITY OF A PREDETERMINED SHAPE RELATED CHARACTERISTICS OF AN OBJECT OR STREAM OF OBJECTS BY SHAPE ANALYSIS

FIELD OF THE INVENTION

The present invention relates to determining a shape related characteristic or property of randomly oriented, irregularly shaped objects by shape analysis. More particularly, the present invention relates to determining the conformity of a shape related characteristic of an object or a stream of objects moving through a detection zone by analyzing the shape of the objects passing through the zone and subsequently treating the object or stream of objects, for example, sorting and the like, according to the conformity of shape with a preselected shape.

BACKGROUND OF THE INVENTION

There are a number of known techniques for physically characterizing irregularly shaped objects. These techniques, which are used primarily for sorting operations, are based upon analysis of light reflected from the objects being characterized. For example, in U.S. Pat. No. 3,357,557, a technique is disclosed for using reflected light as a means of determining the flatness of semi-conductor chips. In U.S. Pat. No. 4,057,146, beans, grain and similar produce are sorted by size and color analysis as a result of light being reflected from the produce. Similarly, various types of ores have been sorted as a function of light reflectance. In this regard, mention is made of U.S. Pat. Nos. 3,097,744; 3,901,388; and U.S. Pat. No. 3,977,526. In addition to the foregoing, mention also is made of ore sorters which use lasers as the light source, such as disclosed in U.S. Pat. No. 3,545,610 and U.S. Pat. No. 4,122,952, and ore sorters which use infrared light as the light source, such as disclosed in U.S. Pat. No. 4,236,640.

One of the disadvantages of devices for optical characterization of objects which are based upon color or reflectance as a characterizing criteria is that use of such devices is limited to applications where there are significant color or light reflectance differences between different classes of the objects being characterized. In the minerals processing field, for example, commercial use of such optical devices for sorting ores generally has been limited to sorting sheelite from gangue and magnesite from gangue since the minerals being sorted possess special fluorescent and reflectance properties making the sort possible. Many minerals and, indeed, other objects requiring sorting do not have the requisite optical properties rendering them susceptible to sorting based on their surface properties. Thus, there remains a need for means to characterize and sort or otherwise treat randomly oriented irregularly shaped objects from a stream of objects.

SUMMARY OF THE INVENTION

In its simplest sense, the present invention contemplates a method and apparatus for determining a characteristic or property of randomly oriented, irregularly shaped objects by shape analysis. Having determined the characteristic or property of the objects analyzed, they can be treated appropriately, for example, sorted and the like.

Stated differently, the present invention contemplates a method and apparatus for obtaining a predetermined shape parameter of an object or a stream of objects, comparing the parameter so obtained with a preselected criteria for that parameter and treating the object or stream of objects based on the degree of comparison.

One aspect of the present invention therefore comprises sorting a stream of irregularly shaped objects, especially a stream of objects such as rocks, including mineralized rocks, i.e., ore, by measuring the shape of each object to be sorted by convergent series in polar form, comparing the measured shape to a pre-established shape criteria and thereafter classifying the objects based on conformance to the shape criteria.

Thus, in one embodiment of the present invention, an apparatus for sorting randomly oriented, irregularly shaped objects comprises means for obtaining digital signals related to the shape of each of the objects being sorted, means operable on said digital signals for obtaining a shape measurement for each object by convergent series in polar form, means for comparing such shape measurement against a preestablished shape criteria and, thereafter, classifying each object based on the conformance with the shape criteria.

In another embodiment of the present invention, digital signals representing a two dimensional image of an object being sorted are obtained with a video scanner. This shape measurement is then quantified using Fourier series analysis. Thereafter, cluster analysis of the shape measurements are used to statistically distinguish the shape of a single object between two or more groups of objects. Finally, means are provided for separating objects whose shape differs from a predetermined shape.

In yet another embodiment of the present invention, a method and apparatus for controlling ore processing comprises measuring the shape of ore passing through a detection zone, comparing the shape so measured with a preselected shape criteria and thereafter controlling the subsequent processing of the ore based on the degree of conformity of the measured shape with the shape criteria.

BRIEF DESCRIPTION OF THE DRAWINGS

FIG. 2 is a flow chart illustrating the shape analysis scheme of the present invention.

FIG. 3 is a graph showing the relationship between copper content and particle shape in porphyry copper ore.

FIG. 4 is a graph showing the correlation between the 8th harmonic amplitude spectra of ore and its mineralization.

DETAILED DESCRIPTION OF THE INVENTION

Figure 1:
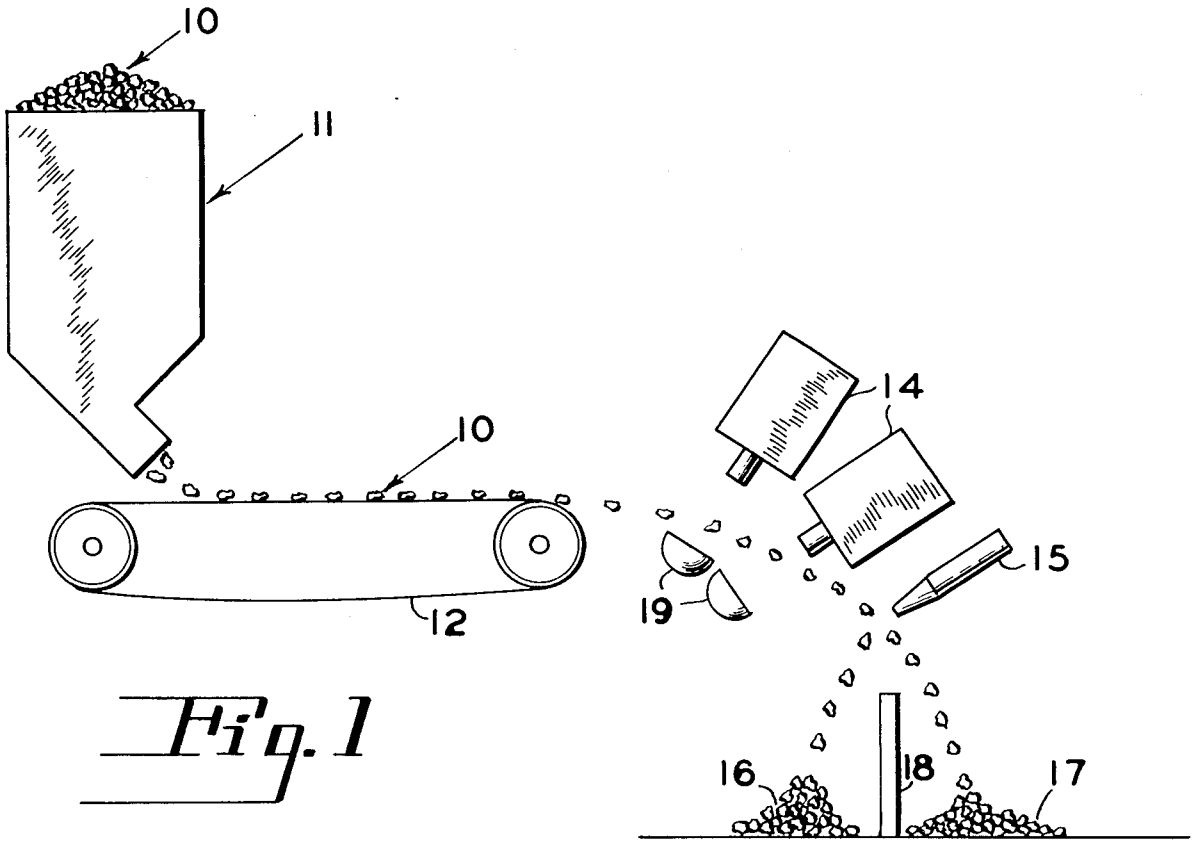
FIG. 1 is a schematic illustration of an apparatus for the separation of irregularly shaped articles in accordance with the present invention.

Since the present invention is particularly suited to sorting randomly oriented, irregularly shaped objects, such as rocks, so as to classify, for example, mineralized from non-mineralized rock, for convenience, the description which follows will make specific reference to ore sorting. However, it should be readily apparent that the invention may be used for grade control in minerals processing, for sorting other objects such as mechanical parts and for controlling other object treatment steps.

Turning now to FIG. 1, there is shown an ore sorting apparatus in accordance with one embodiment of the present invention. In this device, a feed hopper 11 is provided for containing, metering and feeding rocks 10 to be sorted onto an endless conveyor 12. The rocks 10 are discharged from the endless conveyor 12 at a predetermined rate and in a trajectory which causes the particles to pass first through a scanning zone. The scanning zone includes a light source 19 for illuminating the rocks 10 as they pass through the zone and detection means 14 for obtaining at least one view and preferably two views of each rock passing through the zone.

A wide variety of light sources 19 may be employed including fluorescent, laser, incandescent and halogen lamps. Preferably, the light source is stroboscopic.

Similarly a wide variety of detection means 14 may be employed. In general, the detector means 14 employed in the practice of the present invention should be one which will provide digital signals which are related to the two dimensional image of the rock being scanned. Indeed, it is particularly preferred in the practice of the present invention that detector means 14 obtain digital signals for two views of the rock being scanned. Hence in FIG. 1, detector means is shown as two identical devices oriented to obtain a different view of the rock. In one embodiment of the invention, detector means 14 consists of two video cameras and a video digitizer. Thus, the analog signals obtained by the video cameras relating to the two dimensional images of the rock are converted into digital signals. Hence, the digital signals also are related to the two dimensional image of the rock being scanned in the scanning zone. Detector means 14 also includes means, such as a microprocessor, for converting the digital signals acquired for each rock to a shape measurement by convergent series in polar form and comparing that shape measurement with a pre-established shape criteria.

After passing through the scanning zone, each rock passes by a deflection device 15. In the embodiment shown in FIG. 1, the deflection device 15 comprises an air nozzle for applying, at a predetermined time compressed air so as to change the trajectory of a selected rock 10 thereby determining into which pile, 16 or 17, the selected rock will ultimately come to rest. As is readily apparent, other deflection devices may be employed in the practice of the present invention, including reciprocating tables, paddles, water jets and the like. Such deflection devices are well-known in the art. As is suggested by the foregoing, the deflection device 15 is, of course, synchronized with the detector means 14 so that rocks are selectively deflected immediately after they have passed through the view of the detectors depending upon their shape conformance with the pre-established shape criteria. Thus, in the FIG. 1 embodiment, ore is sorted into two classifications, e.g., one group having a predetermined shape and mineralization and a second group having a different shape and mineralization and frequently being non-mineralized. These groups are shown as piles 16 and 17 which may be separated, for example, by means of a barrier, such as barrier 18.

It should be readily appreciated that in the practice of the present invention the object or stream of objects can be passed through the scanning zone in single file in a single row or in a plurality of rows or randomly such as when falling from a wide endless conveyor belt. Similarly, it should be readily appreciated that the stream of objects, e.g., ore, can be separated into grades such as a bulk of ore particles having an average shape characteristic above or below a preselected shape characteristic.

To further illustrate the present invention, the shape analysis scheme shall be described with particular reference to FIG. 2.

As indicated previously, in the practice of the present invention the first step in the shape analysis is a question of the object or objects image. This is achieved by a detector. As mentioned previously the detector means 14 employed should be one which will provide digital signals related to the shape of the rock being analyzed. Hence, if the detector or means for acquiring the objects image is a video scanner or camera the resultant analog signals are converted to a digital format. This can be accomplished using, for example, a CAT 100S sold by Digital Graphic Systems, Palo Alto, Calif. The profile of each particle whose image was detected and "digitized" is determined using a simple thresholding program such as that sold as "Edge" by Symbiotic Concepts Incorporated, West Columbia, S.C. Basically about 500 to 2000 edge points per profile are determined then a subset of 48 edge points are selected from each profile using an appropriate criteria such as that set forth in Full, W. E. and Ehrlich, R. (1982), "Some Approaches for Location of Centroids of Quartz Grain Outlines to Increase Homology Between Fourier Amplitude Spectra", Mathematical Geology, 14, pages 43 to 55. From this subset, a Fourier series in polar form is calculated, and preferably 24 amplitudes per profile are obtained. See for example Ehrlich, R. and Weinberg, B. (1970) "An Exact Method for Characterization of Grain Shape" J. of Sed. Pet., 40, pages 205 to 212.

The data generated, i.e., the 48 amplitude valves are then orthogonalized. In other words, data which tend to be interdependent are operated on algebraically to obtain a new set of variables which are no longer related. This technique is well known. See, for example, "Statistics and Data Analysis in Geology", J. C. Davis, John Wiley and Sons, 1973, p. 473 to 527.

In any event, orthogonalized data obtained from evaluating the shape of each rock of a known class of rocks, e.g., a training class can be compared with orthogonalized data similarly obtained for rocks to be separated or classified by a testing class and the rocks can thereafter be sorted based on the degree of conformance to the pre-established criteria. Typically the orthoganalized data is used to formulate the decision function. For example a discriminant function, multiple regression, or cluster analysis may be employed in making the decision respecting separation or sorting.

Although particular reference has been made to ore sorting, it should be readily appreciated that once having determined the character or property of an object or a stream of objects by the shape analysis procedure described herein, that information can be used as input to control any selected subsequent processing step. For example, in mineral processing the amount of flotation reagents, leaching reagents and the like can be adjusted to suit the particular quality of ore being processed.

To further illustrate the subject invention reference is now made to the following examples.

EXAMPLE 1

Samples of quartz/quartzite rock were obtained from a mine in Montana. In this deposit, silver mineralization is restricted to vein quartz which is white. The non-mineralized quartzite, on the other hand, is pinkish to brown in color. This permitted visual separation of 800 rocks ranging in size from 4 to 10 cm in maximum dimension into 2 groups (a training class and a testing class) of 400 rocks each (200 quartz/200 quartzite). Then each rock in the training class, individually, was placed on a light table. A video camera was used to obtain two orthogonal views of that rock. The first view represented the maximum projection. The second view was at right angles to the first. To see whether the discriminant function equation was in fact "well trained", the profile of each rock of the second sample or Testing Class consisting of quartz and quartzite was obtained and the orthogonalized data so obtained was evaluated by the discriminant function equation determined from the first set or Training Class. After the sorting via the discriminant function was performed, the fragments were identified as to type and the sorting was evaluated.

The discriminant function correctly classified 80% of the ore (vein quartz) and 57% of the non-ore (quartzite) in the Training Class and 65% of the ore and 59% of the non-ore in the Testing Class.

EXAMPLE 2

Four hundred pieces of porphry copper ore (each about 5.0×4.5 cm maximum dimension) were imaged in the same manner as the silver ore. Each piece was given an identification number and then each was analyzed for copper. The average of the samples was 0.3% copper. As typical of such ore, the >3000 ppm Cu fragments contain 72% of the copper and 23% of the mass.

Discriminant functions were constructed in the same way as with silver—by choosing copper-poor fragments (>300 ppm) and copper-rich fragments to form Training and Testing Classes. That is, the discriminant function was trained by employing very copper-rich and very copper-lean fragments since discriminant functions do not perform well if the variation from rich to lean is gradual.

The process was repeated several times and it was noted that as the copper-rich threshold was progressively raised (>1500 ppm, >2000 ppm, >10,000 ppm., etc.) success in discrimination progressively increased. This indicated that a threshold copper value exists above which copper content can be predicted from shape data. Accordingly, a stepwise multiple regression equation was calculated using normalized amplitudes as independent variables. The equation was most influenced by low copper values (>300 ppm) because these constituted the majority of the samples. The equation had approximately zero slope—that is no relationship could be determined between copper content and shape for the bulk of the particles. However, analysis of the spread of points about the regression equation (termed "residuals") indicated that the difference between copper values predicted from the equation compared to actual values was random, below 3000 ppm, but that above 3000 ppm a relationship between copper content and shape exists (see FIG. 3). Above this value then, copper can be sorted using an equation by defining a cutoff value (>3000 ppm) for copper.

EXAMPLE 3

This example illustrates application of the shape analysis concept to grade monitoring on a population basis. About one ton each of quartz and limestone were crushed to minus four inches and 1,063 particles, 530 quartz and 531 limestone, were randomly selected within the size range of 1.5 to 4 inches. Mixtures of limestone and quartz in various proportions were randomly combined from the original 1,063 particles in various percentages (ranging from 0% limestone—100% quartz to 100% limestone—0% quartz in 10% increments), with each sample containing 200 particles. Individual particles from each sample were placed on a light table and video-digitized (single view) and a Fourier harmonic amplitude spectra was generated as previously described.

The frequency-amplitude spectra for each 200 particle sample were then analyzed by the unmixing algorithm "Extended CABFAC—Extended Q Model" (see Klovan, J., and Miesch A.T., (1976), "Extended CABFAC and Q Model Computer Program For Q-Mode Factor Analysis of Computational Data", Computer and Geosciences, Vol. 1, p. 161–178 and, Full, W.; Erlich, R; Klovan, J., (1981) "Extended Space Q-Model-Objective Definition of External End Members In the Analysis of Mixtures", J. Math. Geol., 13, No. 4, p. 331–344). Results were varied in quality from harmonic to harmonic. However, at many harmonics a linear relationship between actual proportion and calculated proportions (oblique loadings) were observed. A strong statistical correlation was observed between the frequency amplitude histogram for harmonic 8 and the actual proportion of quartz and limestone as is illustrated in FIG. 4.

What is claimed is:

1. A method for determining a characteristic or property of randomly oriented irregularly shaped objects comprising:

obtaining an image of the profile of each of said objects;

selecting a plurality of edge points from said profile;

deriving a Fourier series in polar form from said selected edge points whereby a plurality of Fourier amplitudes for each profile is obtained;

orthogonalizing said amplitudes to obtain orthogonalized data; and comparing the orthogonalized data with a pre-established criteria.

2. The method of claim 1 including treating said objects after comparing the orthogonalized data with said pre-established criteria, said treating being a function of the degree of conformity of the data with the criteria.

3. The method of claim 2 wherein said treating is sorting.

4. A method of sorting rocks with at least two classes having different degrees of mineralization comprising:

obtaining groups of rocks having a known degree of mineralization for each class;

obtaining an image profile of each rock in each group; selecting a plurality of edge points from said image profile for each rock; analyzing said edge points to obtain a shape characteristic therefrom for each group; and storing said shape characteristic obtained therefrom;

obtaining an image profile of the rocks to be sorted; selecting a plurality of edge points from said image profile; analyzing said edge points to obtain a shape characteristic for said rocks;

comparing said shape characteristic of each rock so obtained with the stored shape characteristic of each group of rock of known mineralization; and sorting said rocks based on the degree of conformance to said shape characteristic.

5. Apparatus for sorting randomly oriented, irregularly shaped objects comprising:

a scanning zone;

a deflection zone;

means to feed the objects to be sorted through said scanning zone and thence through said deflection zone, said scanning zone including detector means capable of obtaining an image of the profile of said objects passing through said scanning zone, selecting a plurality of edge points from said profile, obtaining a plurality of Fourier amplitudes in polar form for each profile and orthogonalizing said amplitudes to obtain orthogonalized data;

means capable of comparing the orthogonalized data with a pre-established shape criteria;

means to provide an output signal based on a preestablished standard of conformance of said measured shape with said pre-established shape criteria; and means in said deflection zone operable on said output signal deflecting said object so compared into a collection zone whereby all of said objects are stored as a function of their shape.

6. The apparatus of claim 5 wherein said detector means obtains two views of the object passing through said scanning zone.

7. Apparatus for determining a characteristic or property of an object or stream of objects comprising:

a scanning zone;

means for passing said object or stream of objects through said scanning zone;

said scanning zone including means for obtaining an image profile of said object or objects;

means for selecting a plurality of edge points from said profile;

means for obtaining a Fourier series in polar form from said selected edge points whereby a plurality of Fourier amplitudes for each profile is obtained;

means for orthogonalizing said amplitudes to obtain orthogonalized data; and means for comparing the orthogonalized data with a preselected shape criteria.

8. The apparatus of claim 7 including output signal means responsive to the degree of conformity of said shape parameter with said preselected shape criteria.

* * * * *